United States Patent [19]

Zahrowski

[11] Patent Number: 4,969,675

[45] Date of Patent: Nov. 13, 1990

[54] PORTABLE PET REFUSE SCOOP

[75] Inventor: Robert M. Zahrowski, Portland, Oreg.

[73] Assignee: Aaron M. Zahrowski, Portland, Oreg. ; a part interest

[21] Appl. No.: 450,165

[22] Filed: Dec. 13, 1989

[51] Int. Cl.[5] ..... A01K 29/00; A01B 1/04

[52] U.S. Cl. ..... 294/1.3; 15/236.08; 294/55

[58] Field of Search ..... 294/1.3, 1.4, 7, 49, 294/51, 52, 55, 55.5, 57, 131; 15/104.8, 236.01, 236.02, 236.08, 257.1, 257.2; 16/110 R; 172/371, 378, 380, 381

[56] References Cited

U.S. PATENT DOCUMENTS

| | | | |
|---|---|---|---|
| D. 251,582 | 4/1979 | Ziegler et al. | 172/378 X |
| D. 283,062 | 3/1986 | Lordi | 294/55 X |
| 656,093 | 8/1900 | Caruthers | 294/49 |
| 1,432,798 | 10/1922 | Spence | 15/236.01 |
| 1,441,194 | 1/1923 | Forssberg | 294/55 X |
| 2,517,247 | 8/1950 | Seley | 15/236.02 X |
| 3,214,834 | 11/1965 | Bell | 15/236.02 X |
| 3,310,332 | 3/1967 | Nelson | 294/1.4 X |
| 4,103,952 | 8/1978 | Thompson | 294/1.3 |
| 4,483,560 | 11/1984 | Lordi | 294/1.3 |
| 4,536,910 | 8/1985 | Clark | 15/236.01 X |

FOREIGN PATENT DOCUMENTS

| | | | |
|---|---|---|---|
| 2642524 | 3/1978 | Fed. Rep. of Germany | 294/1.3 |
| 2155744 | 10/1985 | United Kingdom | 294/1.3 |

*Primary Examiner*—Johnny D. Cherry

*Attorney, Agent, or Firm*—Eugene D. Farley

[57] ABSTRACT

A pet refuse scoop comprises a head having a plurality of curved teeth extending outwardly from one side and a handle extending in the opposite direction on the other side. The head is defined by a barrier wall for retention of the refuse. The handle has a pressure pad for applying thumb pressure during use. The scoop may be molded as an integral unit and is readily portable in a bag or sack designed for reception of the refuse.

3 Claims, 1 Drawing Sheet

PORTABLE PET REFUSE SCOOP

BACKGROUND AND GENERAL STATEMENT OF THE INVENTION

This invention relates to pet refuse scoops.

In view particularly of contemporary municipal pet litter laws, it has become imperative to have available for use an appropriate implement for removing such litter from diverse surfaces such as pavements, sidewalks, flowerbeds and lawns.

It is the general purpose of the present invention to provide such an implement which may be used effectively on a wide variety of surfaces, particularly on grass, from which such litter normally is removable only with difficulty.

Other important objects of the invention are the provision of a pet refuse scoop having the following advantages:

It is provided with a shield for protection of the hand of the user from soiling.

It is provided with retention means for retaining the refuse while transferring it to a receptacle.

It is provided with a pressure pad for exerting thumb pressure as required for optimum operating efficiency.

It is strong and durable for use over long periods of time.

It may be manufactured simply as an integral unit of molded plastic.

It is a particular purpose of the invention to provide an efficient pet refuse scoop having the foregoing advantages but which is small in size, rendering it portable so that it may be carried conveniently in a paper or plastic sack as the pet owner walks his pet.

The foregoing and other objects of the invention are accomplished by means of a pet refuse scoop which, broadly considered, comprises a scoop head comprising a flat, refuse supporting plate.

A plurality of wide, substantially coplanar, refuse scooping teeth extend outwardly from one end of the scoop head.

A handle extends outwardly from the other end of the head. The handle is provided on its upper surface adjacent the head with an upwardly extending pressure pad for exerting positive pressure on the scoop during its use. Additionally, the pressure pad is contoured and dimensioned to protect the hand of the user from soiling by the scoop contents. All of these functional units are embodied in a scoop of small compass which may be molded inexpensively from an inexpensive, durable, plastic material.

THE DRAWINGS

DESCRIPTION OF A PREFERRED EMBODIMENT OF THE INVENTION

Figure 1:
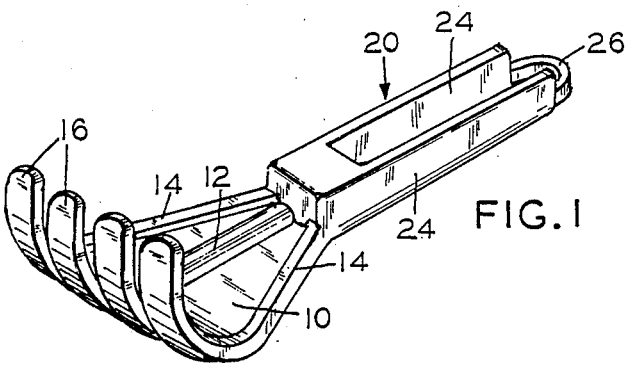
FIG. 1 is a view in top perspective of the pet refuse scoop of my invention.
Figure 2:
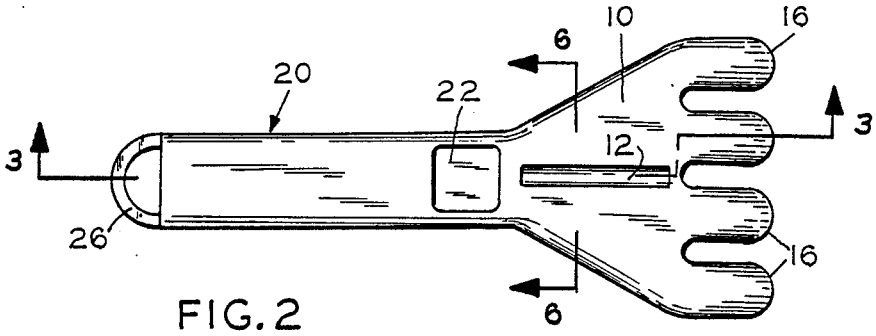
FIG. 2 is a bottom plan view of the scoop.
Figure 3:
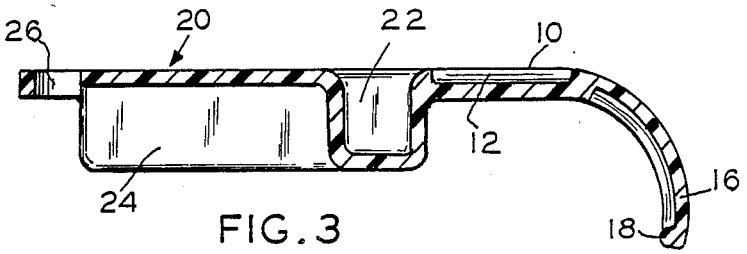
FIG. 3 is a longitudinal sectional view taken along line 3—3 of FIG. 2.
Figure 4:
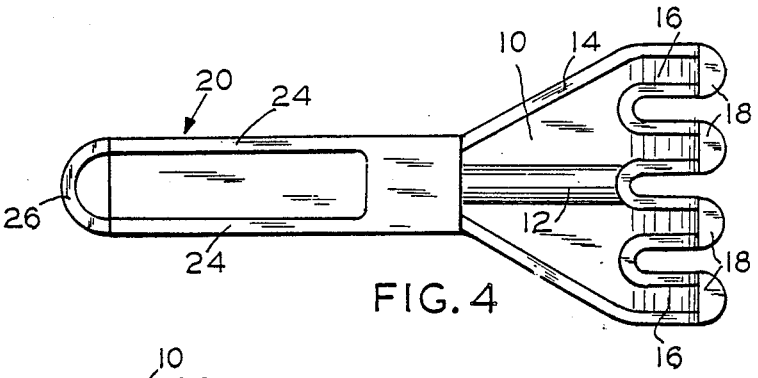
FIG. 4 is a top plan view of the scoop.
Figure 5:
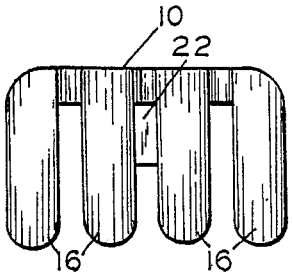
FIG. 5 is a front elevation of the scoop.
Figure 6:
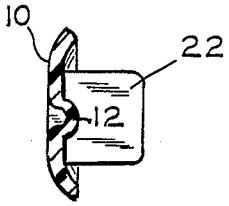
FIG. 6 is a transverse sectional view taken along line 6—6 of FIG. 2.

As noted above, the pet refuse scoop which I have devised is of small size, as compared with the prior art devices and may be formed integrally from a single piece of molded plastic. As compared with the conventional broom and dust pan type of refuse remover, it comprises but a single, all-inclusive operating unit.

As is shown in the drawings, the scoop comprises a head 10 in the form of a flat, refuse-supporting plate.

A flared longitudinally extending rib 12 is located centrally of the head. It serves a stiffening and strengthening function.

The head is surrounded by, and defined by, a marginal rib 14 which serves dual functions. First, it further strengthens and stiffens the head. Second, it serves as a retaining wall for preventing spillage of the collected refuse.

A plurality of wide, substantially coplanar, spaced, refuse-scooping teeth 16 extend outwardly from one end of head 10. The teeth are curved upwardly in the indicated manner to provide a scoop which renders the implement particularly effective in grass. They are strengthened and defined by tooth ribs 18 which may be merely a linear continuation of marginal rib 14 of the head. They serve the same functions as the latter, namely strengthening the teeth and providing a barrier wall for enclosing a litter-receiving area.

A handle indicated generally at 20 extends outwardly from the other end of head 10, preferably coaxially and coplanar therewith.

The handle has on its upper surface adjacent the head an upwardly extending pressure pad 22. This is located in a position such that it can be reached conveniently by the thumb of the user during operation of the tool. It is the forwardly facing surface of the pressure pad that provides a shield for protecting the hand of a user from soiling, as previously mentioned.

Handle 20 also is provided with a pair of spaced, elongated skirts 24 extending upwardly, one on each side. These strengthen and stiffen the handle. They also give body to it so that it is more easily gripped by the user. The boundary areas between the skirts and the head preferably are radiused for increased comfort in use. A loop 26 extends rearwardly from the handle 20 to facilitate hanging the scoop for storage.

There thus is provided in a single unit a readily portable implement useful for its intended purpose in removing pet refuse from difficult situations, supporting and containing the refuse, and transporting it to a container provided for the purpose.

Having thus described in detail a preferred embodiment of the invention, it will be apparent to those skilled in the art that various physical changes may be made in the invention described without altering the inventive concepts and principles embodied. The present embodiment is therefore to be considered as illustrative and not restrictive, the scope of the invention being indicated by the appended claims.

I claim:

1. A pet refuse scoop comprising:

(a) a scoop head comprising a flat, refuse-supporting plate having an upwardly facing refuse-supporting surface, (b) a plurality of refuse-scooping teeth extending outwardly and upwardly from one end of the scoop head, (c) a handle extending outwardly from the other end of the scoop head and having an upwardly facing surface corresponding to the upwardly facing surface of the scoop head, and (d) a pressure pad having an upwardly extending surface extending upwardly from the upwardly facing surface of the handle adjacent the scoop head for exerting positive thumb pressure on the scoop during its use, (e) the upwardly extending surface of the pressure pad facing the scoop head forming a shield to protect the hand of the user from soiling by the scoop contents.

2. A pet refuse scoop comprising:

(a) a scoop head comprising a flat, refuse-supporting plate having an upwardly facing refuse-supporting surface, (b) a plurality of wide refuse-scooping teeth extending outwardly and upwardly from one end of the scoop head, (c) a handle extending outwardly from the other end of the scoop head, and (d) an upwardly projecting retaining wall extending about the periphery of the scoop head and teeth for retaining refuse within the retaining wall.

3. A pet refuse scoop comprising:

(a) a scoop head comprising a flat, refuse-supporting plate having an upwardly facing refuse-supporting surface, (b) a plurality of wide, refuse-scooping teeth extending outwardly and upwardly from one end of the scoop head, (c) a handle extending outwardly from the other end of the scoop head and having an upwardly facing surface corresponding to the upwardly facing surface of the scoop head, (d) a pressure pad having an upwardly extending surface extending upwardly from the upwardly facing surface of the handle adjacent the scoop head for exerting positive thumb pressure on the scoop during its use, (e) the upwardly extending surface of the pressure pad facing the scoop head forming a shield to protect the hand of the user from soiling by the scoop contents, and (f) an upwardly projecting retaining wall extending about the periphery of the scoop head and teeth for retaining refuse within the retaining wall.

* * * * *